US009091146B1

(12) United States Patent
Whiddon et al.

(10) Patent No.: US 9,091,146 B1
(45) Date of Patent: Jul. 28, 2015

(54) SUBSEA UMBILICAL SYSTEM WITH CABLE BREAKOUT

(71) Applicant: AKER SOLUTIONS INC., Houston, TX (US)

(72) Inventors: John Whiddon, Mobile, AL (US); Heith Little, Mobile, AL (US)

(73) Assignee: AKER SOLUTIONS INC., Houston, TX (US)

( * ) Notice: Subject to any disclaimer, the term of this patent is extended or adjusted under 35 U.S.C. 154(b) by 0 days.

(21) Appl. No.: 14/257,556

(22) Filed: Apr. 21, 2014

(51) Int. Cl.
*E21B 43/013* (2006.01)

(52) U.S. Cl.
CPC ..... *E21B 43/013* (2013.01)

(58) Field of Classification Search
CPC ..... E21B 43/013; F16L 1/26; F16L 39/00; H02G 15/14; H02G 9/12
USPC ..... 166/339, 341, 343, 344, 347, 367, 368, 166/345, 350–352; 405/158, 169, 173; 285/120.1, 124.3, 913, 914
See application file for complete search history.

(56) References Cited

U.S. PATENT DOCUMENTS

| | | | | | |
|---|---|---|---|---|---|
| 3,280,908 | A * | 10/1966 | Todd | 166/340 |
| 3,312,777 | A * | 4/1967 | Lovett, Jr. et al. | 174/71 R |
| 3,450,948 | A * | 6/1969 | Paul et al. | 361/63 |
| 3,984,622 | A * | 10/1976 | Ross | 174/72 A |
| 4,826,277 | A * | 5/1989 | Weber et al. | 385/100 |
| 6,519,395 | B1 * | 2/2003 | Bevan et al. | 385/100 |
| 2006/0005970 | A1 * | 1/2006 | Smith | 166/343 |
| 2006/0137880 | A1 * | 6/2006 | Figenschou et al. | 166/367 |
| 2007/0044972 | A1 * | 3/2007 | Roveri et al. | 166/367 |
| 2010/0038899 | A1 * | 2/2010 | Clover et al. | 285/120.1 |
| 2012/0234597 | A1 * | 9/2012 | Madden | 174/74 R |
| 2013/0014688 | A1 * | 1/2013 | Yemington | 114/264 |

* cited by examiner

*Primary Examiner* — James G Sayre
(74) *Attorney, Agent, or Firm* — Rothwell, Figg, Ernst & Manbeck, P.C.

(57) ABSTRACT

A subsea umbilical system can be provided for connecting a topside structure at a proximal end of the system to subsea equipment at a distal end of the system. The system can include an umbilical configured to allow one or more cables for powering or communicating with subsea equipment to be passed through at least a portion of the umbilical. The system can further include reinforcing elements radially surrounding a portion of the umbilical. The system can further include a breakout box disposed along the umbilical and configured to be positioned between the reinforcing element and the subsea equipment. The breakout box can include a breakout opening configured to allow one or more breakout cables to exit the umbilical and run along the outside of the reinforcing elements to the topside structure. Related methods of making and using such systems are also described.

19 Claims, 12 Drawing Sheets

SUBSEA UMBILICAL SYSTEM WITH CABLE BREAKOUT

BACKGROUND

1. Field

The present invention relates generally to subsea development projects, and more particularly to improved subsea umbilical systems with one or more cable breakouts.

2. Background

Deep-water subsea projects can refer to offshore projects located in water depths greater than around 600 feet. Such projects can be used, for example, to develop and maintain oil and gas reservoirs. Subsea well equipment used for such projects can be located on the seabed and operatively connected to a topside surface structure, such as a ship or other floating platform. In such projects, one or more umbilicals are often used to convey fluids, power, and/or send electrical and other communication signals between the surface structure and the subsea well equipment. There is a continuous need for improved subsea umbilical systems for deep-water subsea projects as well as other subsea projects.

BRIEF SUMMARY

It has been found that elements of certain umbilical systems can trap an undesirable amount heat within the system and that such heat trapping elements can negatively affect the performance of the system. For example, in some situations, medium voltage cables are unable to reach a desired amperage capacity within an umbilical due to heat trapping characteristics of elements such as a bend stiffener, I-tube, J-tube, and/or potting barrel of the umbilical system. That is, if such power cables are operated within these heat trapping elements at too high of a voltage, heat generated by the cable may build up to a level that can damage the umbilical or other elements of the umbilical system by decreasing the effectiveness of their mechanical properties, which can, in effect, reduce their life span. Certain embodiments of the present description can avoid such undesirable heat trapping characteristics by breaking one or more cables out of the umbilical, such as power cables, and not allow excessive heat build-up within the umbilical due to heat trapping elements. This can allow the power cables to be operated at higher currents, which can improve performance of the umbilical system. Because umbilical systems are often designed such that cables do not function as load carrying elements breaking these cables out of the umbilical can produce a minimal or even negligible effect on the rigidity and load bearing characteristics of the umbilical system.

In some embodiments, a subsea umbilical system can be provided for connecting a topside structure at a proximal end of the system to subsea equipment at a distal end of the system. The system can include an umbilical configured to allow one or more cables for powering or communicating with subsea equipment to be passed through at least a portion of the umbilical. The system can further include a reinforcing element radially surrounding a portion of the umbilical. The system can further include a breakout box disposed along the umbilical and configured to be positioned between the reinforcing element and the subsea equipment. The breakout box can include a breakout opening configured to allow one or more breakout cables to exit the umbilical and run along an outside of the reinforcing element to the topside structure.

In some embodiments, a method of assembling a subsea umbilical system is provided. The method can include passing one or more cables for powering or communicating with subsea equipment through a portion of an umbilical. The method can further include breaking out the one or more cables of the umbilical. The method can further include continuing the umbilical above that point without the breakout cable or cables through a reinforcing element radially surrounding a portion of the umbilical. The method can further include electrically coupling breakout cables to electrical flying lead cables through the use of connectors so that the breakout cables are run along the outside of the reinforcing element.

BRIEF DESCRIPTION OF THE DRAWINGS

The accompanying drawings, which are incorporated herein and form part of the specification, illustrate various embodiments of the present disclosure and, together with the description, further serve to explain the principles of the disclosure and to enable a person skilled in the pertinent art to make and use the embodiments disclosed herein.

DETAILED DESCRIPTION

The following description is intended to convey a thorough understanding of the embodiments described by providing a number of specific embodiments and details relating to subsea umbilical systems. It should be appreciated, however, that the present invention is not limited to these specific embodiments and details, which are exemplary only. It is further understood that one possessing ordinary skill in the art would appreciate the use of the invention for its intended purposes and benefits in any number of alternative embodiments, depending upon specific design and other needs.

Figure 1:
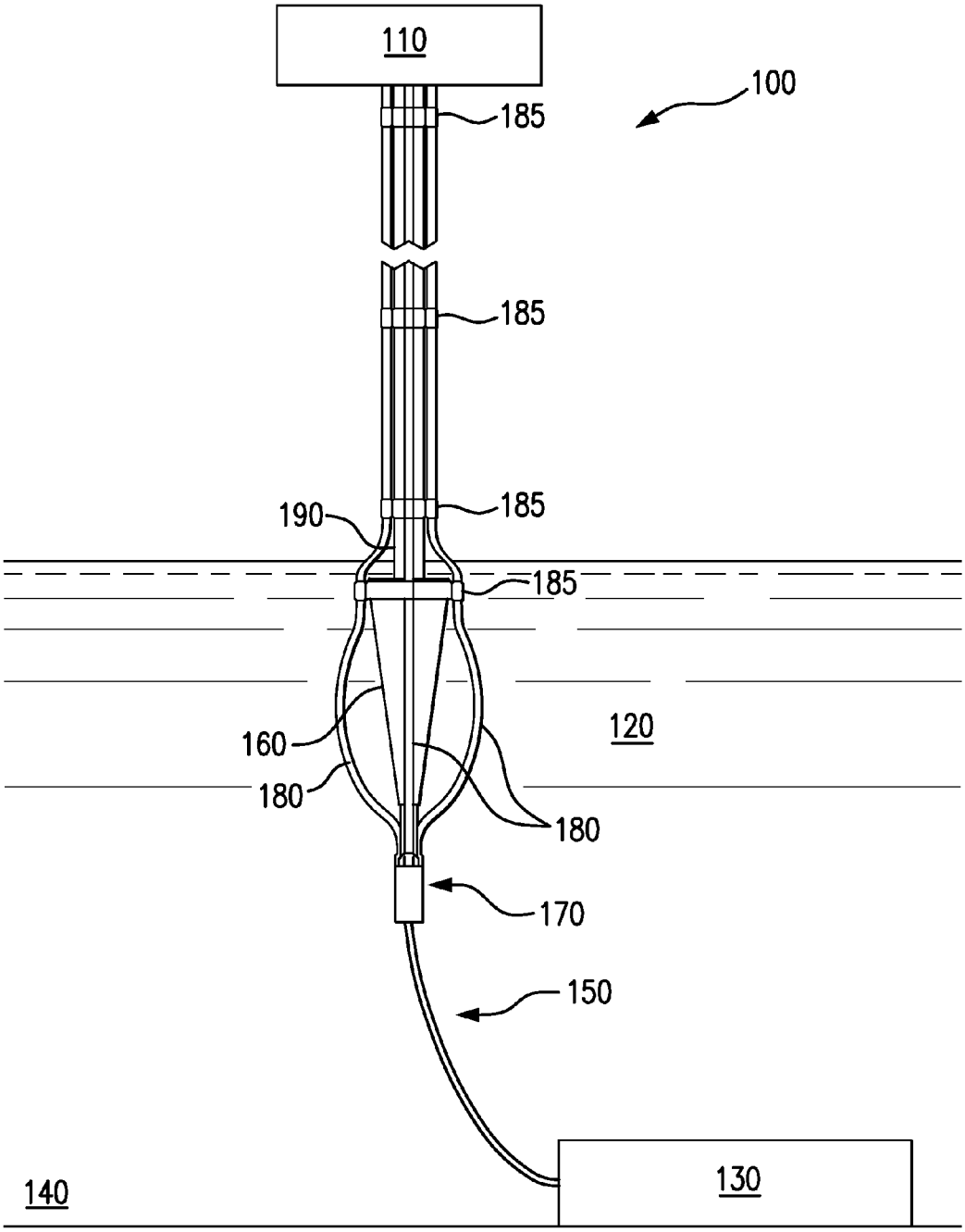
FIG. 1 illustrates a diagram view of a subsea umbilical system in accordance with one embodiment of the present disclosure attached to a floating structure above a water line and to equipment on the seabed.
Figure 2:
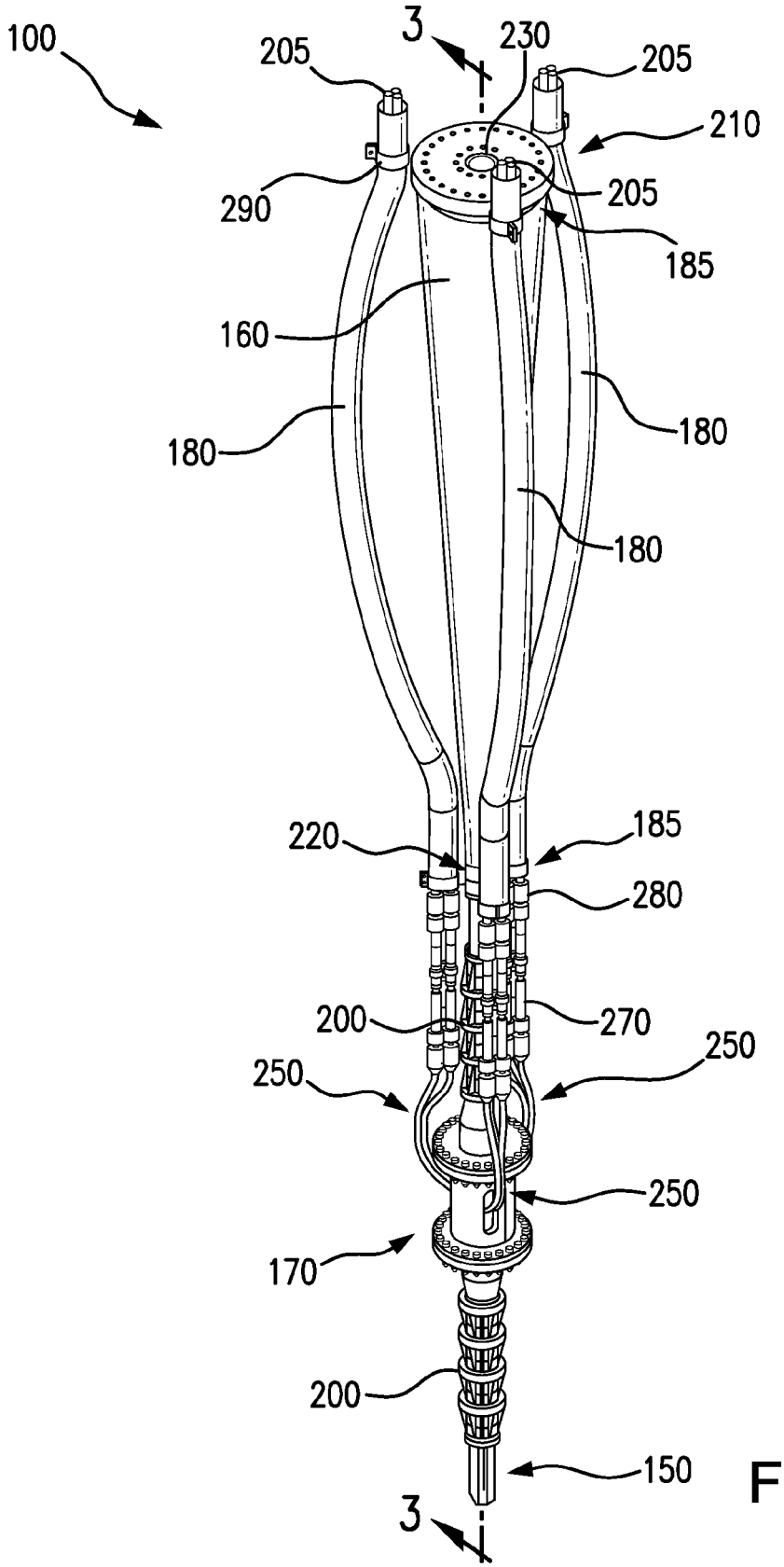
FIG. 2 illustrates a front perspective view of an embodiment of a subsea umbilical system.
Figure 3:
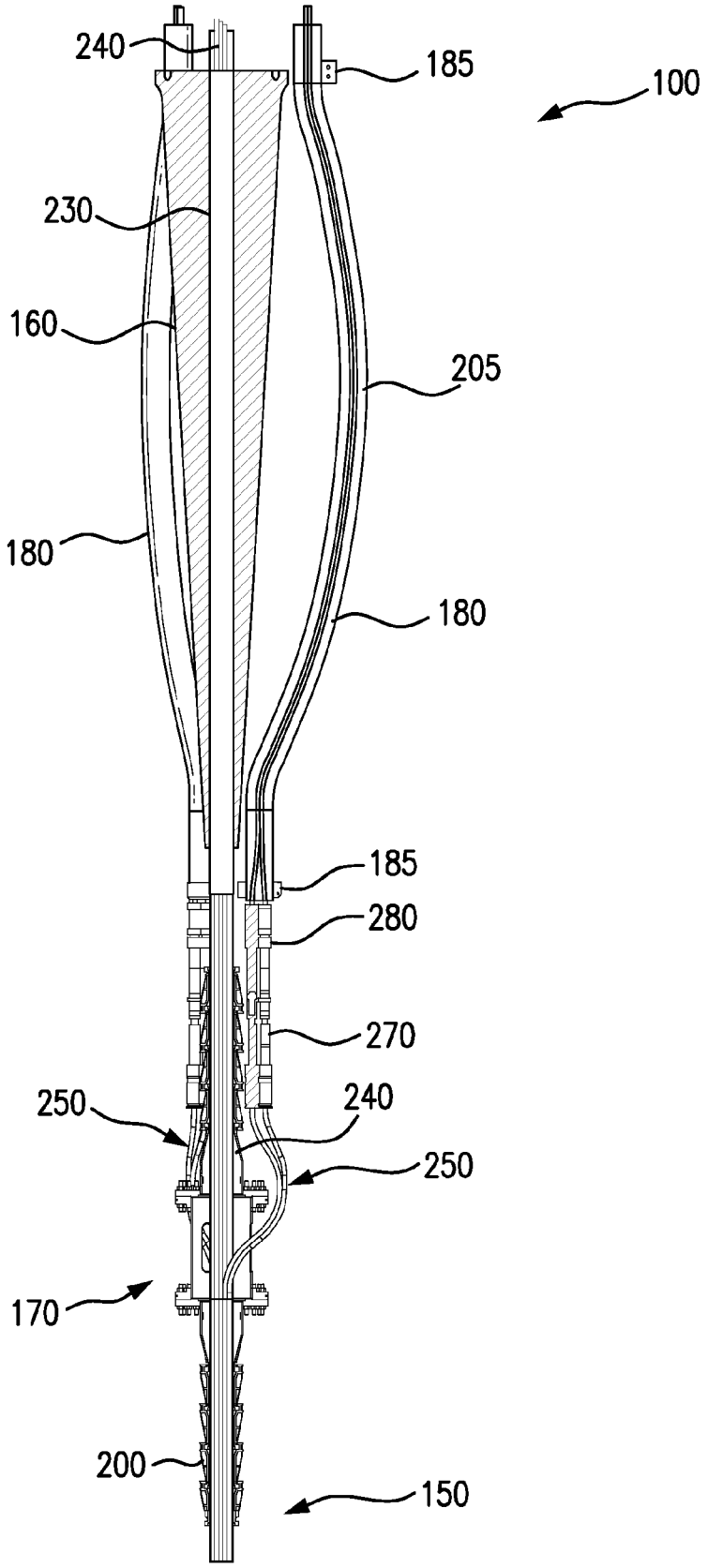
FIG. 3 illustrates a cross-sectional view of the system of FIG. 2 along line 3-3 of FIG. 2.

FIGS. 1-3 illustrates various views of a first embodiment of a subsea umbilical system 100. In particular, FIG. 1 illustrates a diagram view of system 100 attached to a topside structure 110 above water line 120 and further attached to equipment 130 on seabed 140. FIG. 2 illustrates a front perspective view of system 100, and FIG. 3 illustrates a cross-sectional view of system 100 along line 3-3 of FIG. 2.

System 100, as well as other systems described herein, can be configured for use with deep-water subsea projects or other suitable subsea projects. In some embodiments, system 100 can be configured to connect at a first end to a topside structure 110, such as a floating platform and/or floating production facility. In some embodiments, topside structure 110 can be in the form of a ship. It is appreciated that in some embodiments, system 100 can be configured to connect at a first end to a non-floating structure, such as a structure supported entirely or partially by seabed 140. A second end of system 100 can be configured to connect to subsea well equipment 130 or other suitable equipment.

System 100 includes various components, such as an umbilical 150, a bend stiffener 160, a breakout box 170, cluster conduits 180, cluster mounts 185, a tube 190 (shown in FIG. 1), bend restrictors 200 (shown in FIGS. 2-3), and electrical flying leads 205 (best shown in FIG. 3). Each of these components is described in detail below.

As best shown in FIG. 2, umbilical 150 passes through various components of system 100 between topside structure 110 and equipment 130. For example, in some embodiments, umbilical 150 passes through axial passages in bend restrictors 200, breakout box 170, and bend stiffener 160. Umbilical 150 is designed to connect topside structure 110 at a proximal end of system 100 to equipment 130 at a distal end of system 100. Umbilical 150 can, for example, allow one or more cables for powering or communicating with subsea equipment 130 to be passed through at least a portion of umbilical 150. Umbilical 150 is further described below with respect to FIG. 4, which illustrates a cross-sectional view of umbilical 150 and depicts various cables and reinforcing elements positioned within umbilical 150.

Bend stiffener 160 is designed to provide increased rigidity to one or more components of system 100. Bend stiffener 160 can serve as a reinforcing element for system 100 and can be positioned along umbilical 150 so as to radially surround at least a portion of umbilical 150. Bend stiffener 160 can, for example, have a substantially conical shape, with a top end 210 having a greater diameter than an opposite, bottom end 220. As best shown in FIG. 3, which is a cross-sectional view of system 100, bend stiffener 160 can be substantially solid except for a tubular cavity 230 formed therein that extends axially between top end 210 and bottom end 220 of bend stiffener 160. Tubular cavity 230 can be sized to securely receive umbilical 150. For example, tubular cavity 230 can be sized to prevent umbilical 150 from undesired bending within bend stiffener 160 while still allowing umbilical 150 to be easily slid in or out of bend stiffener 160 by an operator if desired. As described above, bend stiffener 160 can function as a heat trapping element that has an undesired effect of trapping undue heat within system 100 and potentially limiting performance of one or more cables of umbilical 150.

Figure 5:
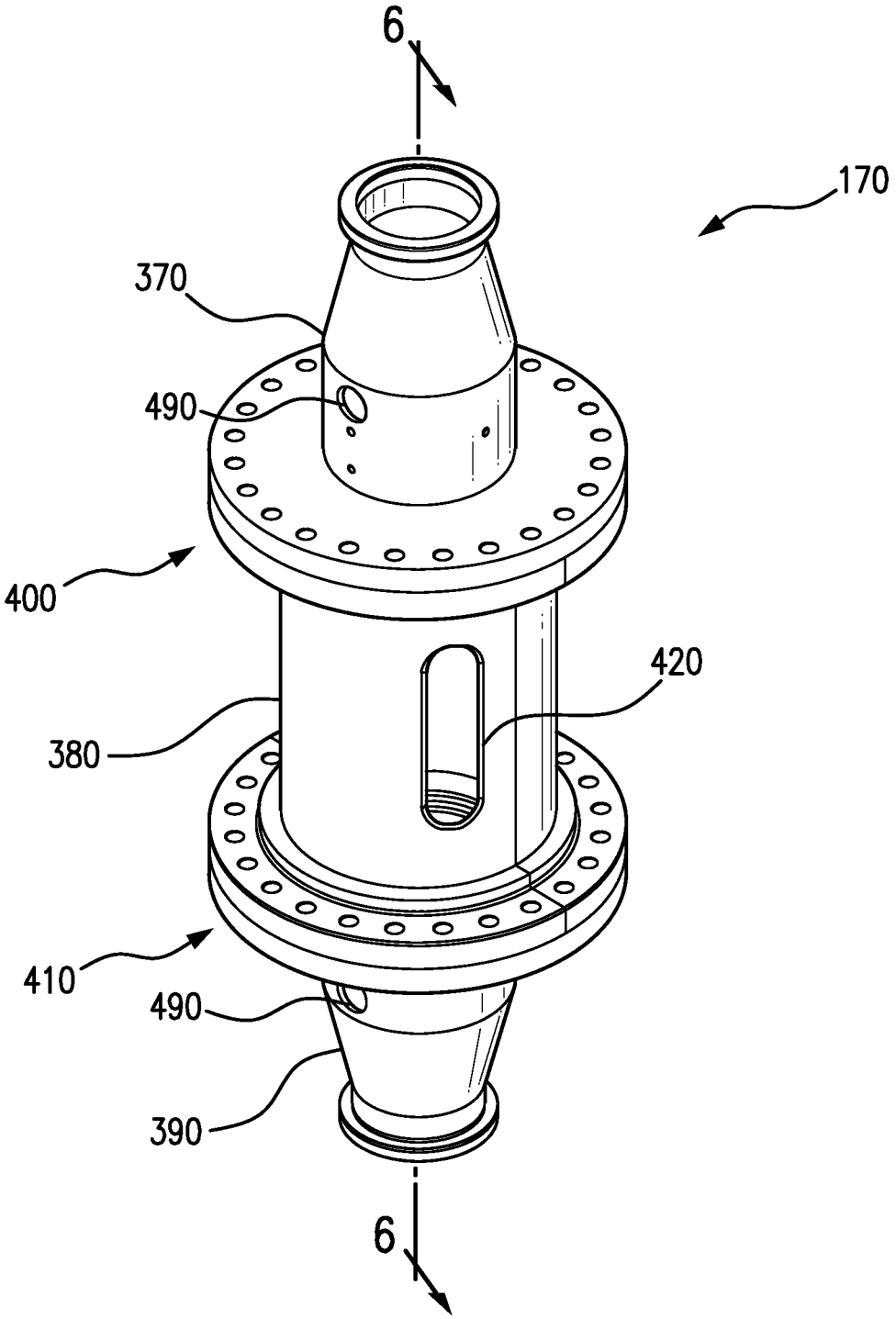
FIG. 5 illustrates a front perspective view of a breakout box suitable for use with the system of FIG. 2.
Figure 6:
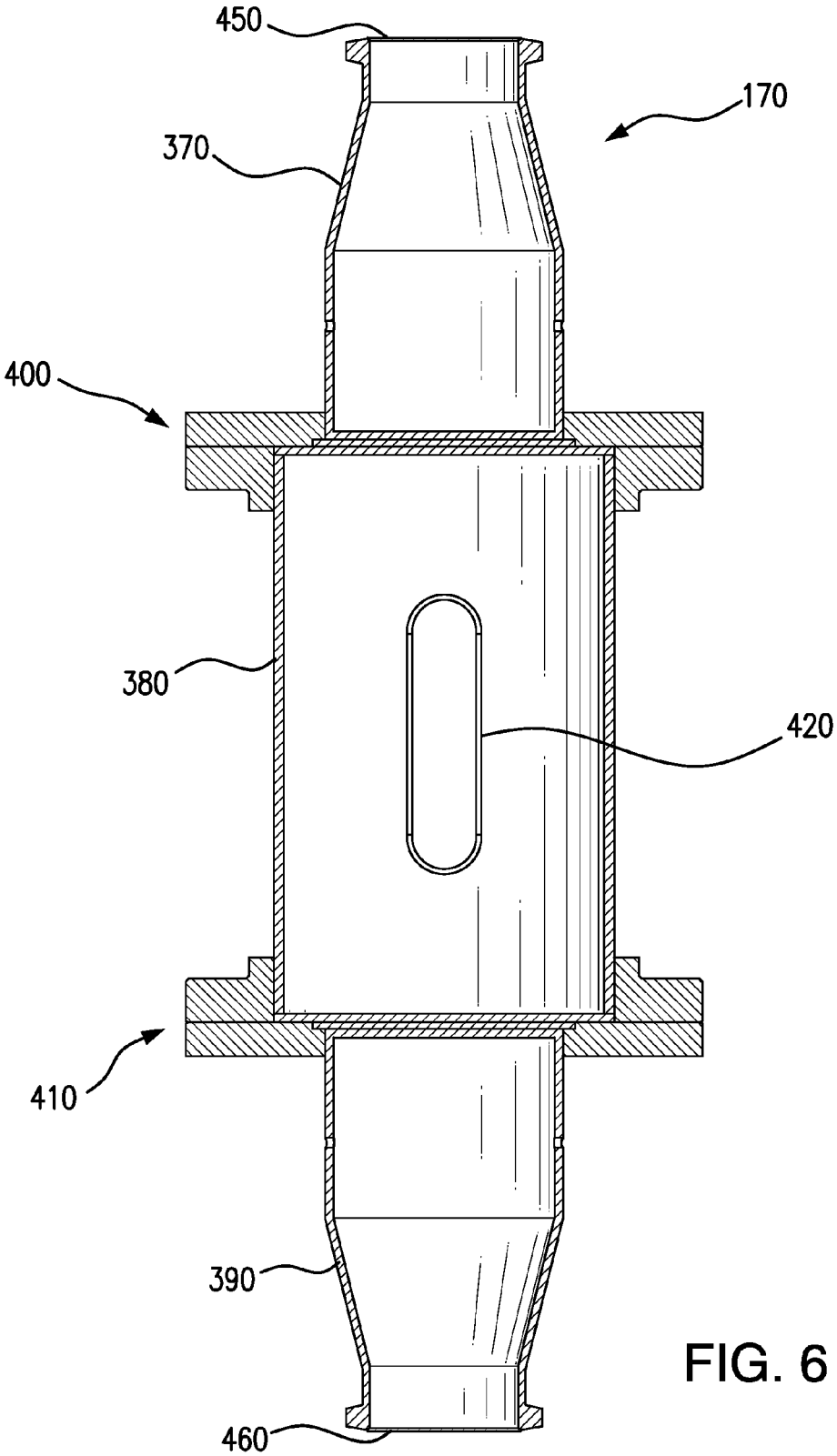
FIG. 6 illustrates a cross-sectional view of the breakout box of FIG. 5 along line 6-6 of FIG. 5.

Breakout box 170, which is described in further detail below with respect to FIGS. 5-6, is designed to allow certain elements of umbilical 150, such as pass-through elements 240, to pass through bend stiffener 160, while allowing other elements, such as breakout cables 250, to break out from umbilical 150 and allow those elements to run along the outside of the bend stiffener 160. Breakout box 170 can be disposed along umbilical 150 between heat trapping elements such (as bend stiffener 160 and tube 190), and subsea equipment 130. In some embodiments, breakout box 170 is located along umbilical 150 such that when umbilical system 100 is in use, breakout box 170 is located below water line 120. It is appreciated that in some embodiments, breakout box 170 can be in another suitable position along umbilical 150.

System 100 includes one or more electrical flying leads 205 that are electrically connected to topside structure 110 at a proximal end and electrically connected to breakout cables 250 at a distal end via electrical connectors. In some embodiments, and as shown for example in FIG. 3, electrical connectors can be positioned outside of breakout box 170. Electrical connectors can, for example, be configured to electrically couple terminal ends 280 of electrical flying lead cables to terminal ends 270 of breakout cables 250 passed through breakout box 170. In some embodiments where electrical flying leads are not used, breakout cables 250 can be passed directly to topside structure 110 through cluster conduits 180. It is appreciated that descriptions herein relating to breakout cables "running" from the breakout box to the topside structure are intended to describe breakout cables being electrically connected to topside structures. For example, this term is intended to include not only continuous uninterrupted lines between the breakout cable and the topside structure, but also electrical connections formed by multiple cable segments (such as a breakout cable segment connected to an electrical flying lead cable segment) or another suitable electrical arrangement.

Each breakout cable cluster conduit 180 is designed to securely receive one or more electrical flying leads 205 and to ensure the flying lead cables run along bend stiffener 160 in an axial direction between breakout box 170 and topside structure 110. Each cluster conduit 180 can be substantially hollow so as to allow electrical flying leads 205 to pass therethrough. As described above, cluster conduits 180 can be used to receive cables, such as power or communication cables, or other elements that may generate unwanted heat within umbilical 150. As such, cluster conduits 180 can be designed to withstand higher temperatures than other elements of system 100 such as umbilical 150. Cluster conduits 180 can be designed to allow seawater to effectively cool the interior cavity thereof to prevent damage to conduit 180 or to cables 205 passed therethrough.

In some embodiments, cluster conduits 180 can run closely along an exterior surface of bend stiffener 160. In other embodiments, such as the embodiment depicted in FIG. 3, cluster conduits 180 can curve away from bend stiffener 160. Cluster conduits 180 can be designed to be flexible to allow them to bend with umbilical system 100. The shape, positioning, and construction of cluster conduits 180 can be configured in accordance with objectives and dynamic analysis requirements. As shown for example in FIG. 3, cluster conduits 180 have substantially constant outer diameters. It is appreciated that in some embodiments, cluster conduits 180 can include non-circular outer surfaces, as well as outer surfaces that vary in dimension or shape along the axial length of the conduits.

Cluster mounts 185 are secured around top end 210 and bottom end 220 of bend stiffener 160 and are designed to securely position cluster conduits 180 around bend stiffener 160. Cluster mounts 185 can be positioned at additional or alternative locations along umbilical system 100. As shown for example in FIG. 2, each cluster mount 185 can include one or more collars 290 for receiving a respective cluster conduit 180. Each collar 290 can, for example, be positioned a uniform distance from an adjacent collar 290. That is, for a system having three cluster conduits 180, each collar 290 can be positioned around bend stiffener 160 approximately 120 degrees apart. Likewise, for a system having two cluster conduits 180, the two collars 290 can be located on opposite sides of bend stiffener 160 and approximately 180 degrees apart.

Bend restrictors 200 are provided at various locations of umbilical 150 in order to restrict undesired bending of umbilical 150 at these locations. For example, as depicted in FIG. 2, a first set of bend restrictors 200 can be positioned just below breakout box 170, with a second set of bend restrictors 200 positioned just above breakout box 170. It is appreciated that additional or fewer bend restrictors 200 can be provided along umbilical 150. Likewise, one or more bend restrictors 200 or other such restrictors can be positioned around other components of system 100 to restrict undesired bending of system 100.

Tube 190 (shown in FIG. 1) can be in the form of an I-tube, J-tube, or other similar tube. Tube 190 can, for example, provide increased rigidity, protection, and/or serve other functions for system 100. Tube 190 is coupled at one end to bend stiffener 160 and at another end to topside structure 110. Tube 190 radially surrounds a section of umbilical 150. Tube 190 includes a tubular cavity to allow umbilical 150 or elements of umbilical 150 to pass through tube 190. As described above, like bend stiffener 160, tube 190 can function as a heat trapping element by undesirably trapping heat within system 100, which may limit performance of one or more elements of umbilical 150.

Figure 4:
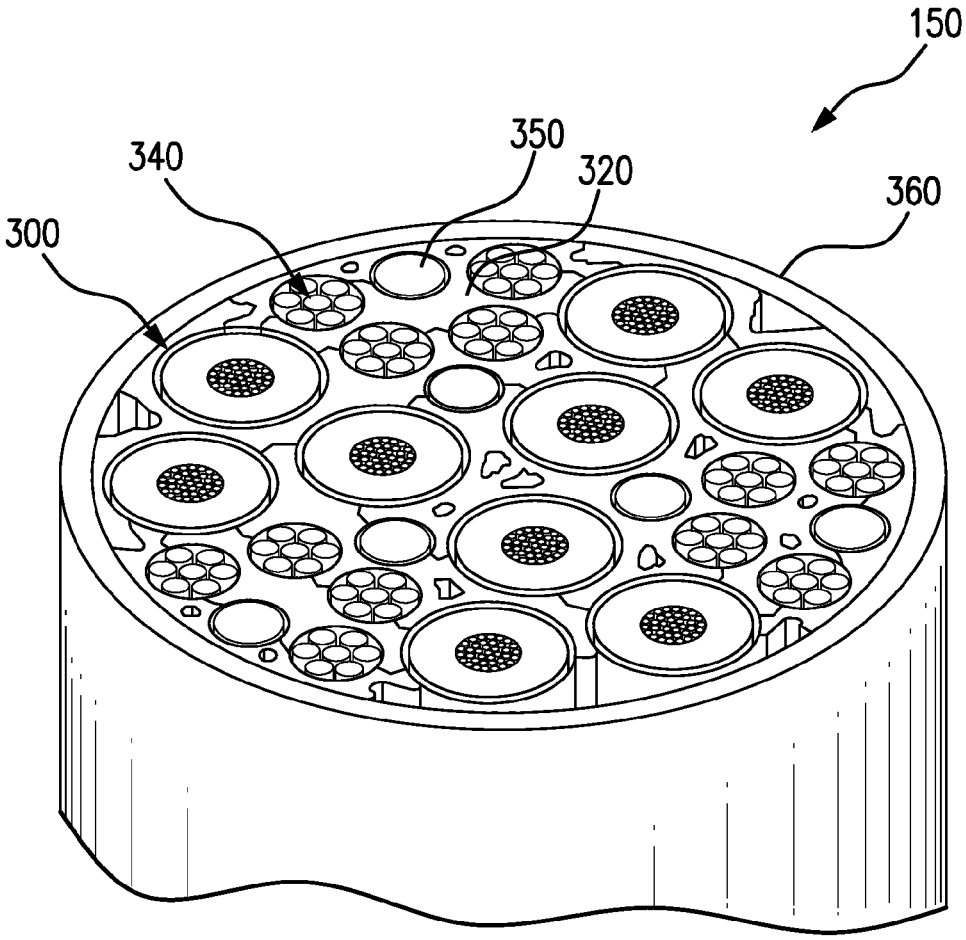
FIG. 4 illustrates a front perspective view of a top end of an umbilical suitable for use with the system of FIG. 2.

FIG. 4 illustrates an embodiment of an umbilical 150 suitable for use with subsea umbilical system 100. As described above, umbilical 150 is designed to allow one or more cables 300 for powering or communicating with subsea equipment 130 to be passed through at least a portion of umbilical 150. It is appreciated that umbilicals providing additional or lesser functionality may be suitable for use with system 100.

In some embodiments, cables 300 can, for example, be cables for powering or communicating with subsea equipment 130. One or more of cables 300 of umbilical 150 can be power cables, such as medium voltage power cables. In some embodiments, one or more of cables 300 of umbilical 150 can be communication cables configured to transfer data between topside structure 110 and subsea equipment 130. It is appreciated that medium and higher voltage power cables may be especially well suited for use in system 100 as such cables tend to generate greater heat than a lower power cable or a data cable. Although FIG. 4 depicts the use of multiple power cables 300, it is appreciated that in some embodiments, umbilical 150 may include more or less power and/or communication cables than illustrated.

Umbilical 150 further includes multiple types of inserts and elements. For example, umbilical 150 includes inserts 320 which can be designed to provide increased impact and crush resistance for umbilical 150, while still allowing one or more elements the freedom to react under axial and bending load conditions. Inserts 320 can be designed to position elements of umbilical 150 in a desired location. Umbilical 150 can include load carrying elements such as a cluster of reinforcing rods 340 or a single reinforcing rod 350 positioned within an opening in insert 320. Load carrying elements can be made from carbon fiber, steel, or another suitable material. It is appreciated that in some embodiments, umbilical 150 can be designed so as not to include an insert 320 or load carrying elements.

Umbilical 150 further includes a protective sheath 360 that surrounds the various interior elements of umbilical 150. The interior surface of sheath 360 forms around umbilical 150 extending between an opening at a distal end of umbilical 150 and an opening at a proximal end of umbilical 150. Sheath 360 can include one or more openings formed in a peripheral surface of sheath 360 to allow one or more breakout cables 250 or other elements to break out from umbilical 150.

FIGS. 5 and 6 illustrate various views of breakout box 170. In particular, FIG. 5 illustrates a front perspective view of breakout box 170 and FIG. 6 illustrates a cross-sectional view of breakout box 170 along line 6-6 of FIG. 5. As depicted in these figures, breakout box 170 is formed by an upper portion 370, a central portion 380, and a lower portion 390. An upper flange 400 is used to connect upper portion 370 to central portion 380, whereas a lower flange 410 is used to connect central portion 380 to lower portion 390. Bolts, welding, or other fastening means can be used to securely connect the various portions.

Central portion 380 is substantially hollow and includes multiple breakout openings 420 for permitting breakout cables to exit from breakout box 170. Upper and lower portions 370 and 390 are substantially solid with cavities formed therein to allow umbilical 150 to axially pass between an upper opening 450 and lower opening 460 in breakout box 170. The outer sheathing 360 and inserts 320 can be removed as needed between the upper and lower openings to allow breakout cables to get free of the umbilical then repaired upon final assembly. The main load carrying elements should remain as straight as possible through this section and protected as needed. Breakout box 170 can further include one or more ventilation holes 490 formed therein.

Figure 7:
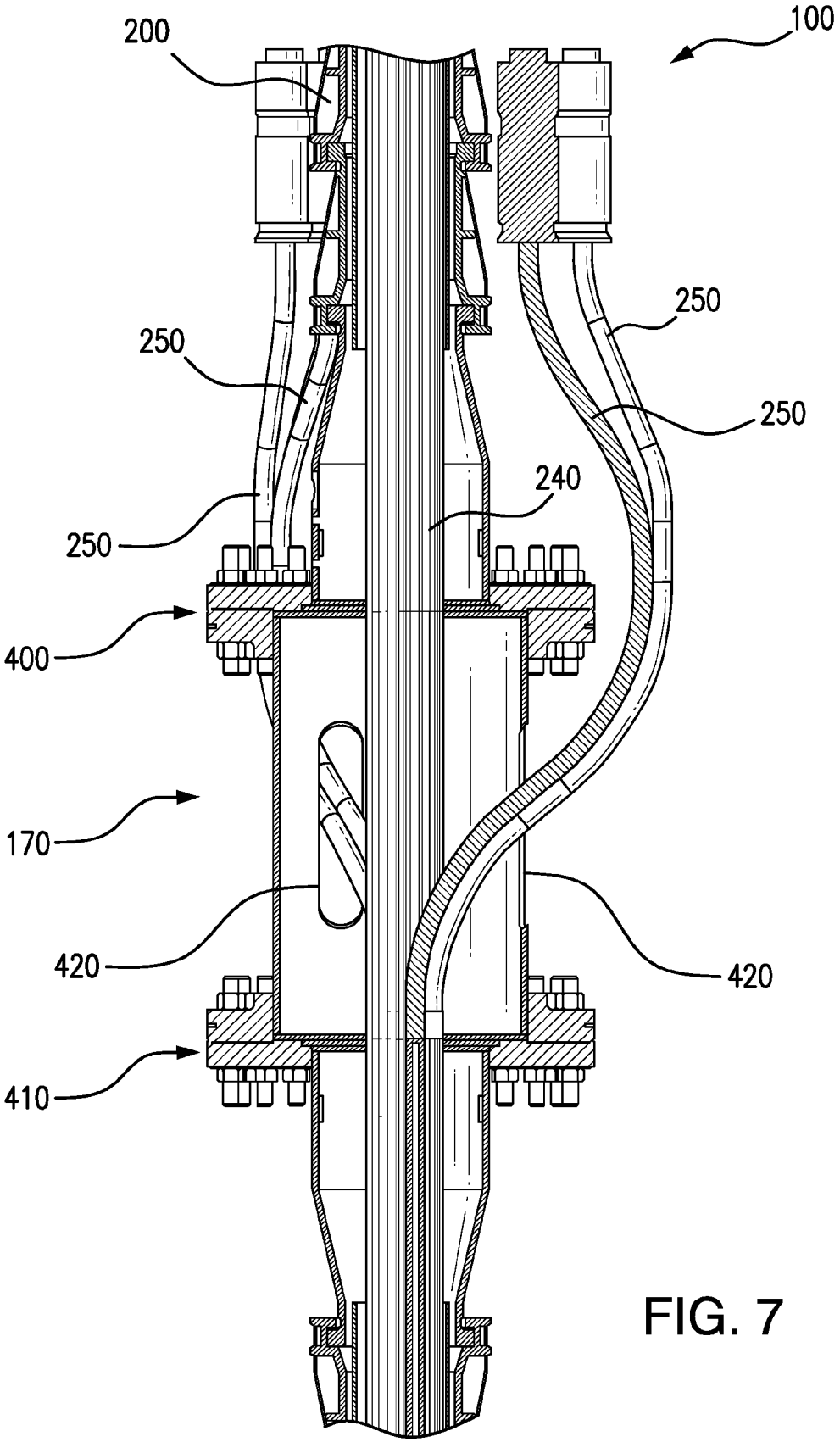
FIG. 7 illustrates an enlarged view of the cross-sectional view of FIG. 3.

FIG. 7 illustrates an enlarged view from FIG. 3 of breakout box 170. As depicted in FIG. 7, breakout cables 250 extend through a breakout opening in sheath 360 and inserts 320 of umbilical 150 and pass through breakout opening 420 formed in breakout box 170. As shown in this view, although breakout cables 250 are broken out of umbilical 150, the remaining elements of umbilical 150 (referred to herein as pass-through elements 240), continue through breakout box 170 and are eventually passed through bend stiffener 160 and tube 190 and eventually to topside structure 110.

Figure 8:
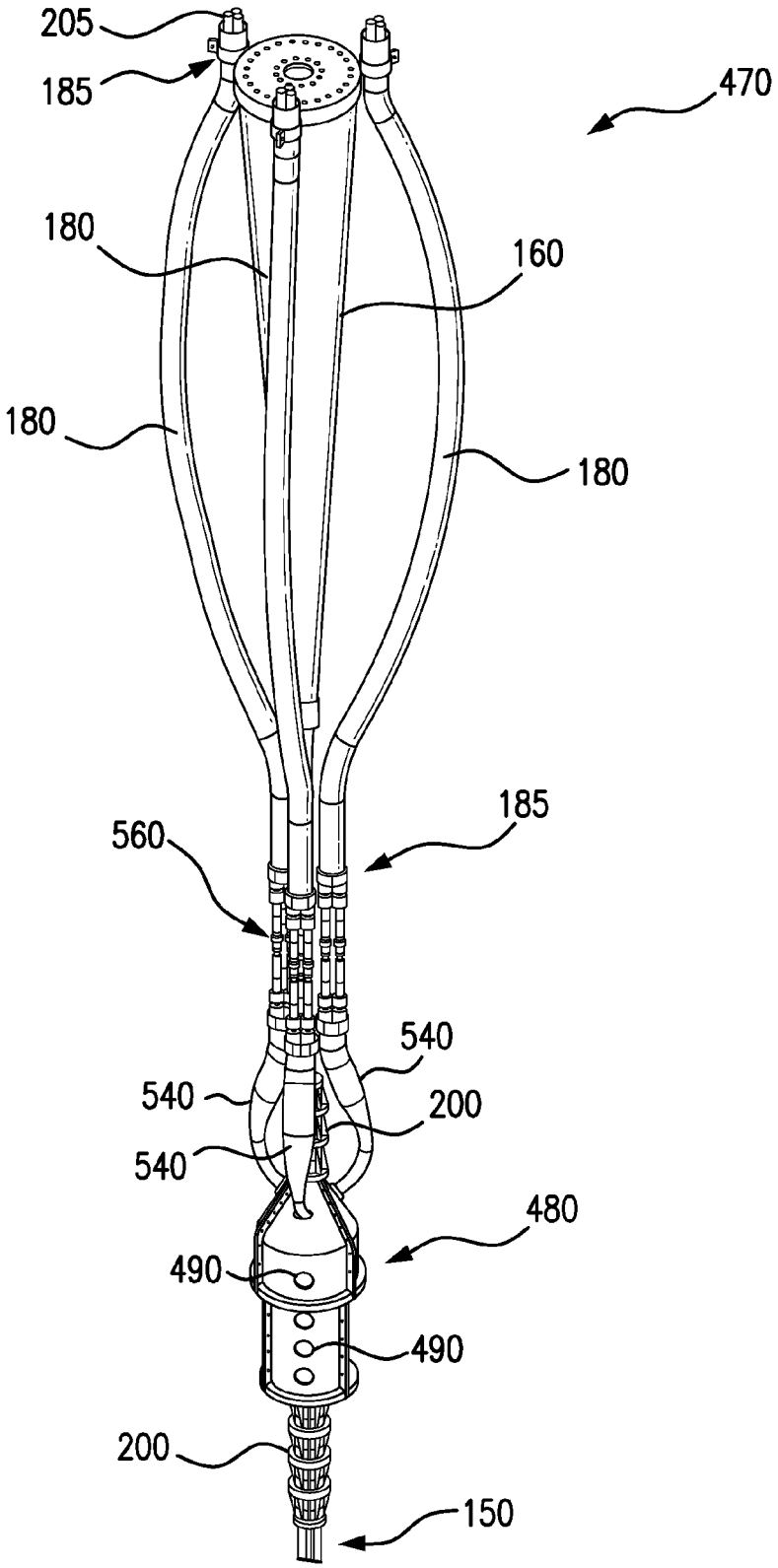
FIG. 8 illustrates a front perspective view of an embodiment of a subsea umbilical system.

FIG. 8 illustrates a second embodiment of a subsea umbilical system 470. System 470, like system 100 described in FIG. 1, can, for example, be configured for use with deepwater subsea projects or other suitable subsea projects. System 470 can include substantially similar elements as system 100, such as umbilical 150, bend stiffener 160, electrical flying leads 205, cluster conduits 180, cluster mounts 185, and bend restrictors 200. System 470 can additionally include a modified breakout box 480 that allows for the tensile load of the umbilical to be carried by the shell of the breakout box 480.

Figure 9:
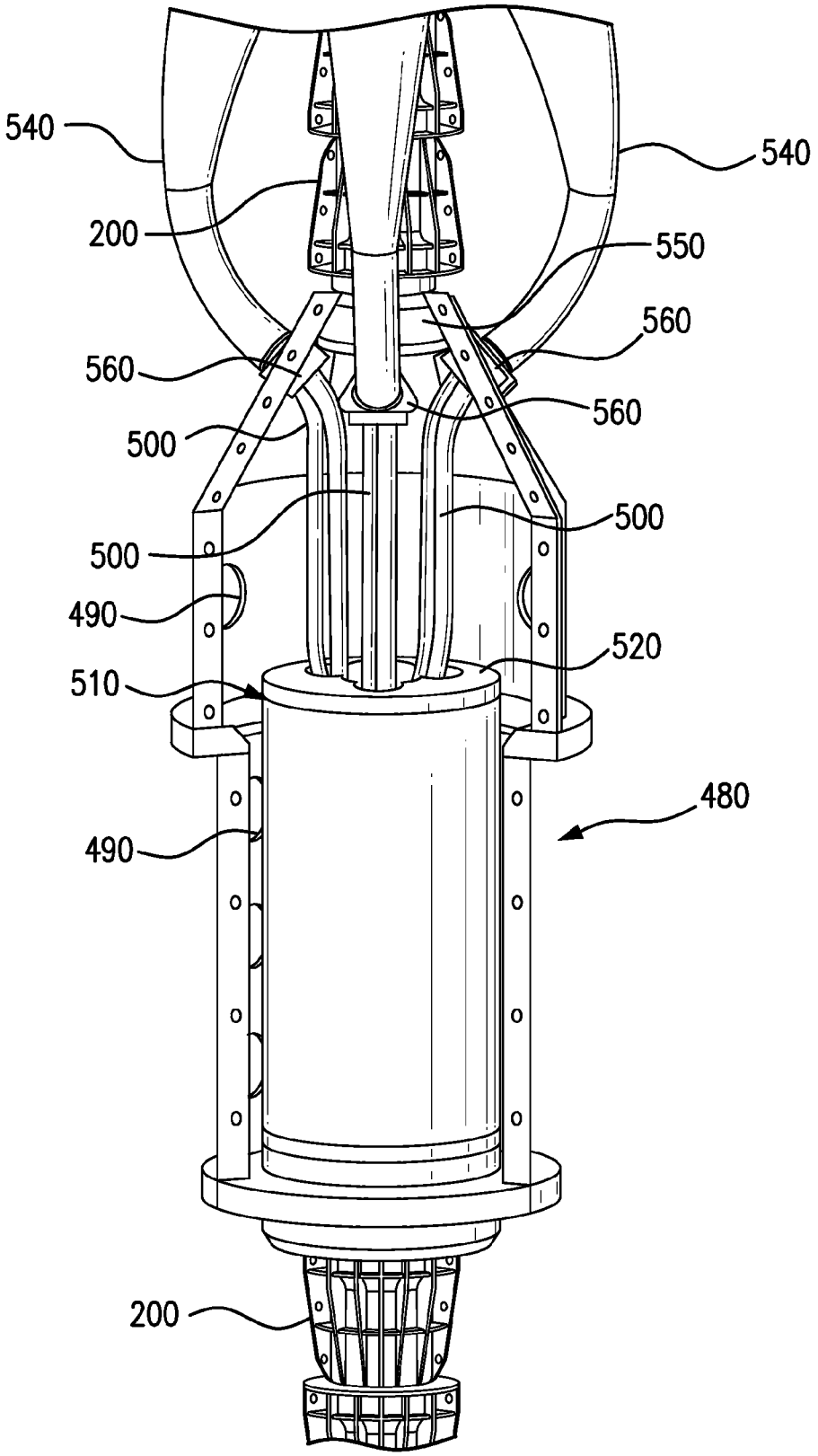
FIG. 9 illustrates a front perspective view of a portion of the system of FIG. 8 with a portion of the breakout box removed for clarity.

FIG. 9 illustrates an interior view of a portion of system 470, with a portion of breakout box 480 removed for clarity. As shown in FIG. 9, similar to breakout box 170, breakout box 480 is substantially hollow and includes multiple breakout openings 560 for permitting breakout cables 500 to exit breakout box 480. Breakout openings 560 can be provided near the top end of breakout box 480 or at another suitable location. Like breakout box 170, breakout box 480 can additionally include one or more ventilation holes 490 formed therein.

System 470 further includes a topside termination 510 that is load bearing and protects various elements of umbilical 150 within breakout box 480. Breakout box 480 provides for hang-off of the umbilical topside termination 510 and transfers the tensile load from the umbilical elements and topside termination to a strength members only umbilical above that point. The top surface 520 thereof allows breakout cables 500 to exit from topside termination 510.

System 470 can include one or more electrical flying leads 205 that are electrically connected to topside structure 110 at a proximal end of flying lead 205 and electrically connected to breakout cable 500 at a distal end via electrical connectors, which is the same method used in system 100. System 470 can further include a second set of cluster conduits 540 that are configured to allow breakout cables and flying lead cables to pass therethrough. System 470 can be used with umbilicals containing power and communication cables and/or non-load carrying hydraulic tubes. In some embodiments, system 470 is designed such that it would not be used where hydraulic steel tubes carry a portion of the load. In such an embodiment, such a configuration would allow separation of strength carrying elements inside the breakout box. Such a configuration could create standardized upper umbilical/bend stiffener sections each with a load range that can be used for multiple umbilical projects. The attachment point of this upper umbilical section to breakout box 480 is shown as load bearing component 550.

Figure 10:
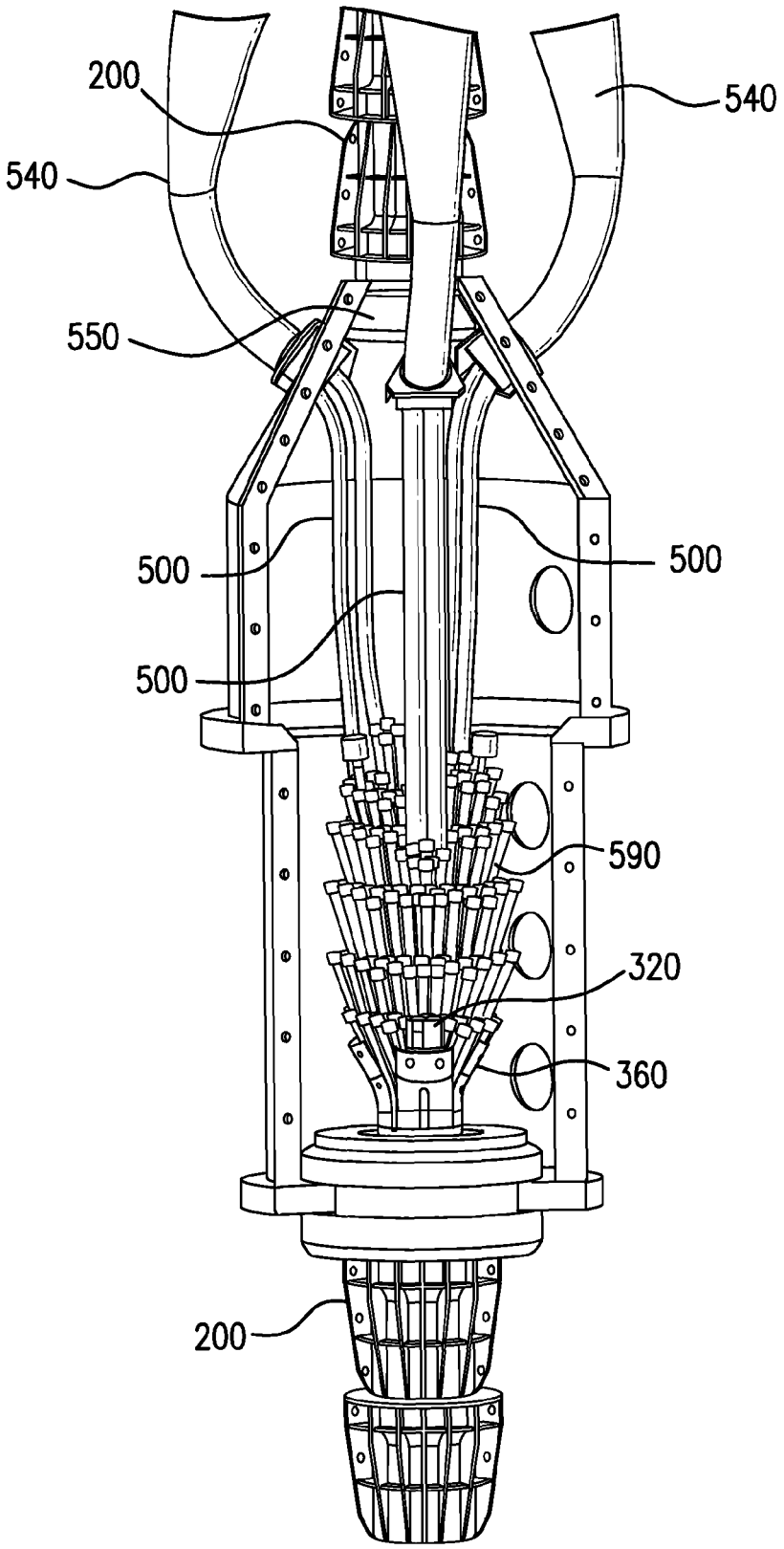
FIG. 10 illustrates the view of FIG. 9 with the topside termination also removed for clarity.

FIG. 10 illustrates the view of FIG. 9 with topside termination 510 additionally removed for clarity. As shown in FIG. 10, elements 590 of the umbilical flare out within topside termination 510. These flared elements 590 are secured within topside termination 510, which hangs-off inside breakout box 480 as shown in FIG. 10. Flared elements 590 can include certain cable reinforcing elements, reinforcing members, or other elements that do not need to be extended past breakout box 480. Flared elements 590 in the form of unused power or data cables can be capped to prevent undesired signal transmission. System 470 can further include flared outer sheathing 360 and inserts 320.

Figure 11:
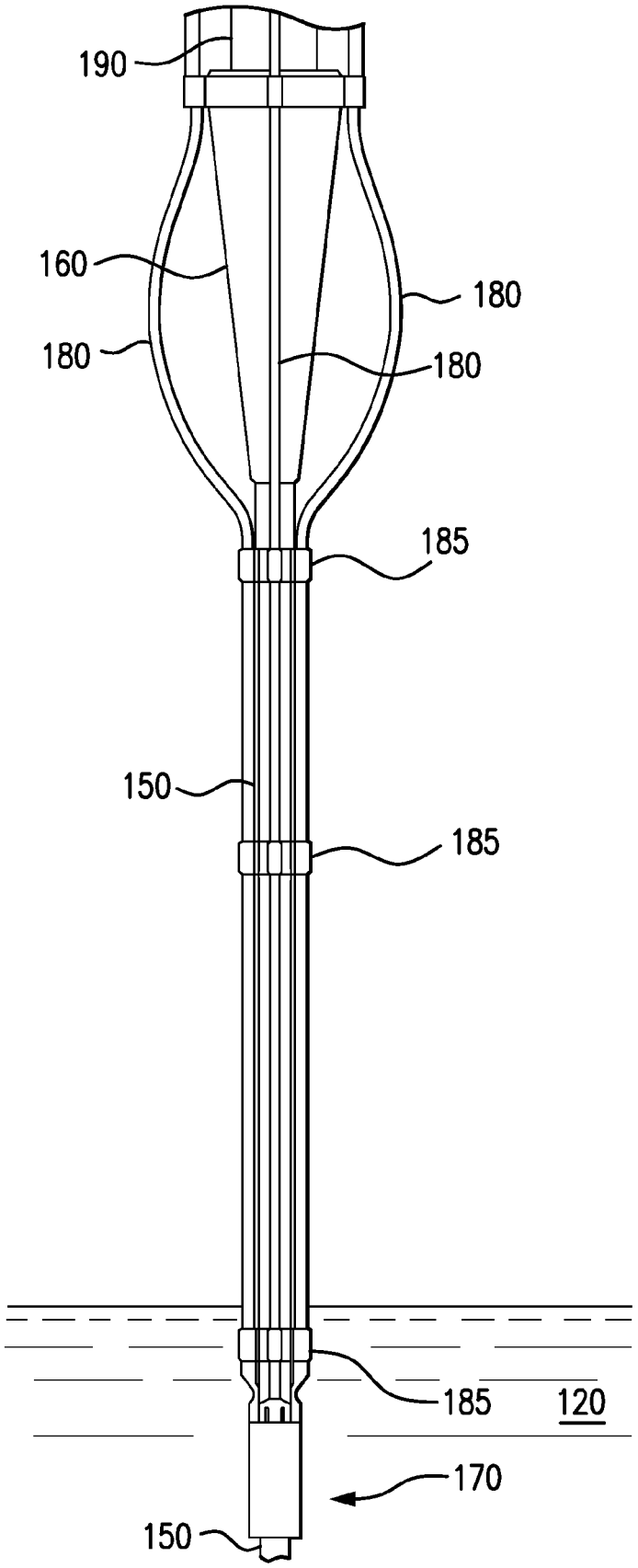
FIG. 11 illustrates a diagram view of a subsea umbilical system in accordance with an embodiment of the present disclosure in which a bend stiffener is located above the water line.

FIG. 11 illustrates a diagram view of a subsea umbilical system in which a bend stiffener of the system is located above the water line. For the sake of convenience, FIG. 11 is labeled with elements from system 100 described herein. However, it is appreciated that one or more other systems described herein can position a bend stiffener or other element of the system above the water line.

Figure 12:
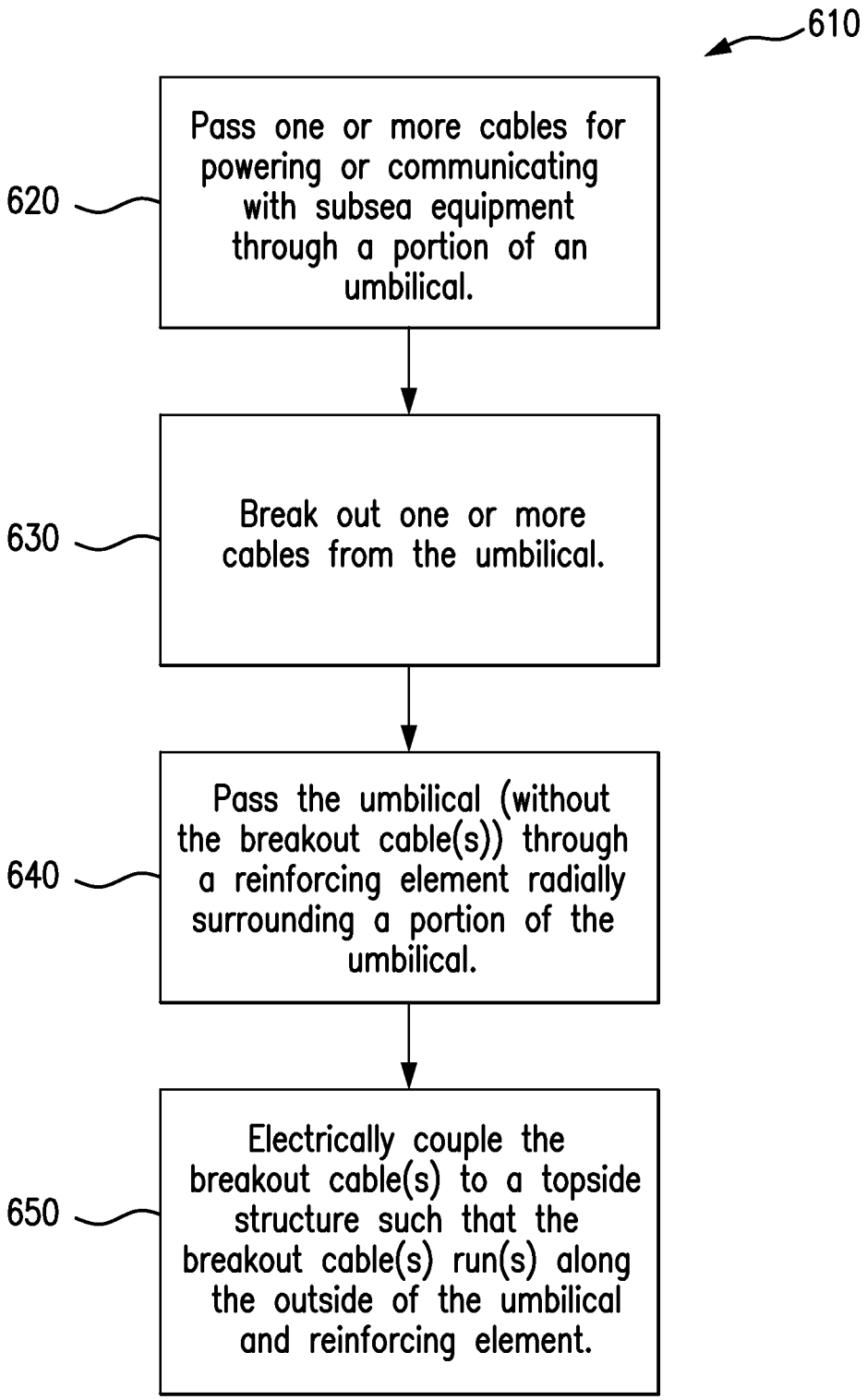
FIG. 12 illustrates a flowchart for a method of assembling a subsea umbilical system in accordance with an embodiment of the present disclosure.
Figure 3:
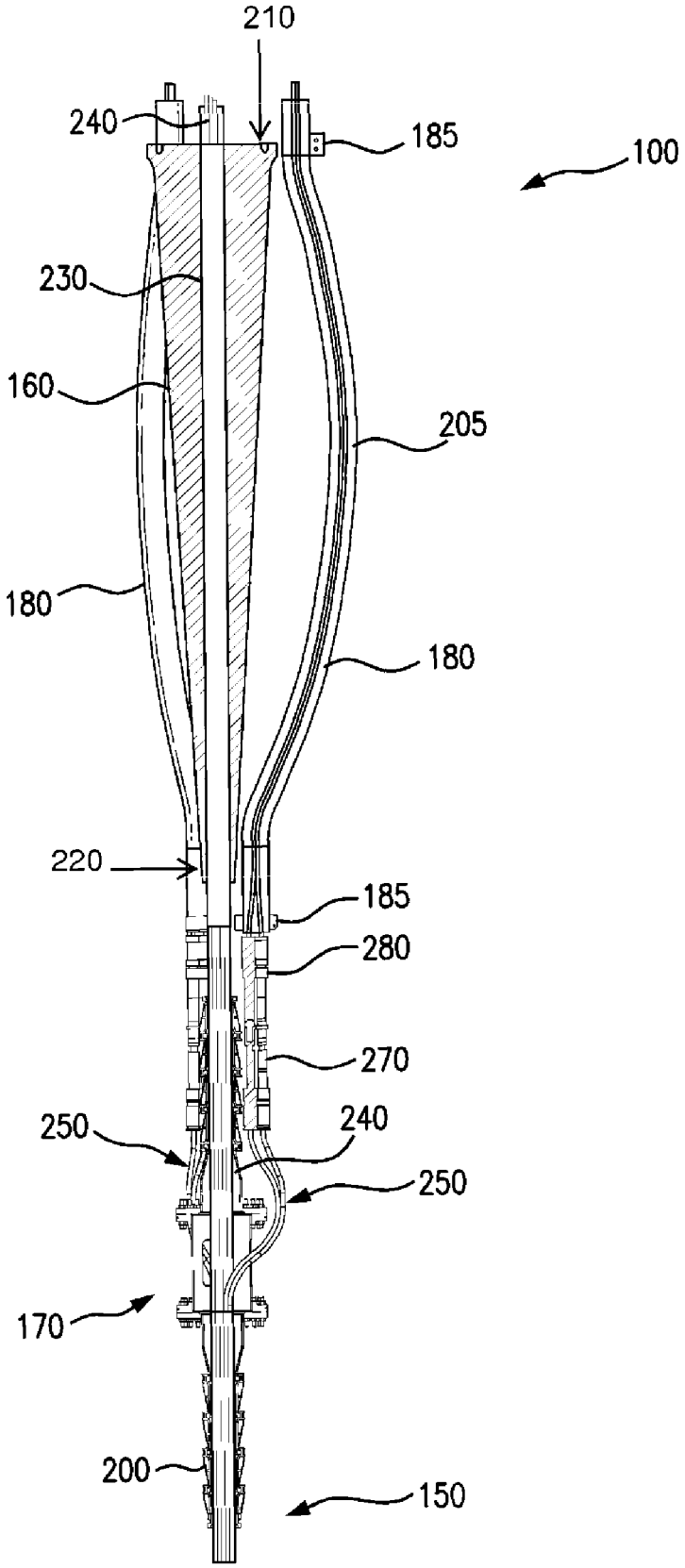
Figure 10:
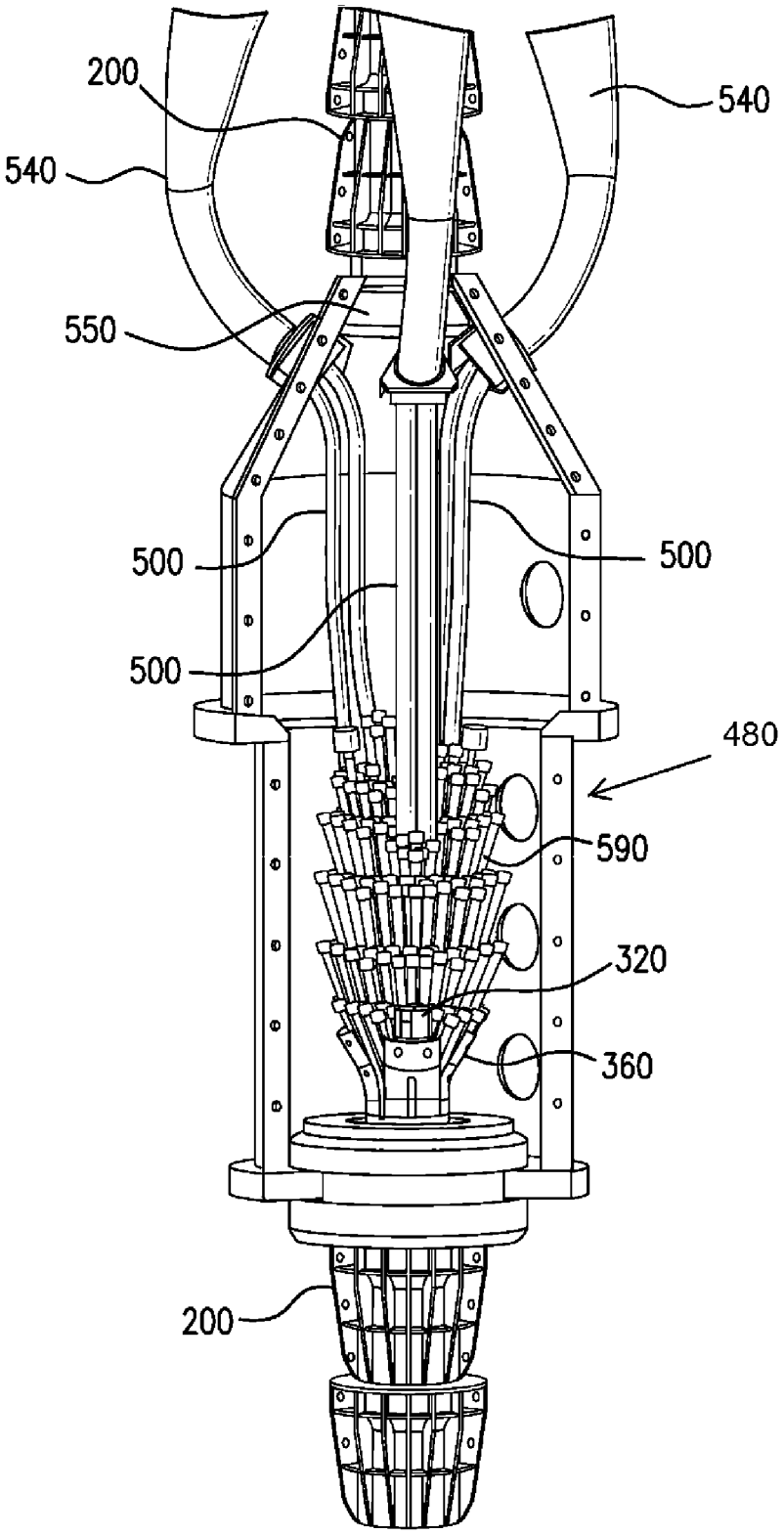

FIG. 12 is a flowchart for a method 610 of assembling a subsea umbilical system. For the sake of convenience, method 610 references elements from system 100 described herein. However, it is appreciated that one or more steps of method 610 can be performed on other suitable systems, such as for example, system 470.

Method 610 includes a step 620 of passing one or more cables 300 for powering or communicating with subsea equipment through a portion of umbilical 150. As described for example with respect to FIG. 4, additional elements, such as load carrying elements 340 and 350, can be passed through umbilical 150.

Method 610 further includes a step 630 of breaking out a breakout cable 250 from the one or more cables 300 of umbilical 150. It is appreciated that an operator may choose, for example, to break out only cables or other elements that do not contribute to the load carrying capacity of umbilical 150. In some embodiments, breakout cables 250 can include every power or data cable within the umbilical, such that only load carrying elements like 340 and 350 are passed through the reinforcing elements (e.g., bend stiffener 160 and/or tube 190).

Method 610 further includes a step 640 of passing umbilical 150 (without breakout cables 250) through a reinforcing element. In some embodiments, breakout cables 250 can be cut with the subsea side terminating into connectors mounted on breakout box 170. Any remaining cable length of breakout cables 250 running to topside structure 110 can merely act as filler inside umbilical 150. In some embodiments, umbilical 150 (without breakout cables 250) is installed on structure 110, and flying leads 205 are lowered through holes in structure 110 around tube 190 and bend stiffener 160.

Method 610 further includes a step 650 of electrically coupling breakout cables 250 to topside structure 110 such that breakout cables 250 are run along the outside of a reinforcing element. In some embodiments, step 650 can be performed by a diver electrically connecting flying leads 205 to breakout cables 250 extending from breakout box 170. In some embodiments, step 650 can include coupling breakout cables 250 to a flying lead 205 that runs along the outside of a reinforcing element. In some embodiments, step 650 can include attaching breakout cables 250 and flying lead cables 205 to electrical connectors (such as electrical connectors 270 and 280) and joining the electrical connectors together outside of breakout box 170.

All numbers in this description and figures indicating amounts, ratios of materials, physical properties of materials, and/or use are to be understood as modified by the word "about," except as otherwise explicitly indicated. The choice of materials for the parts described herein can be informed by the requirements of mechanical properties, temperature sensitivity, moldability properties, or any other factor apparent to a person having ordinary skill in the art. For example, one or more of the parts described herein (or a portion of one of the parts) can be made from suitable metals, rubber, alloys, plastics, and/or other suitable materials.

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

Additionally, while the processes described above and illustrated in the drawings are shown as a sequence of steps, this was done solely for the sake of illustration. Accordingly, it is contemplated that some steps may be added, some steps may be omitted, the order of the steps may be re-arranged, and some steps may be performed in parallel.

What is claimed is:

1. A subsea umbilical system for connecting a topside structure at a proximal end of the system to subsea equipment at a distal end of the system, the umbilical system comprising:

an umbilical configured to allow one or more cables for powering or communicating with subsea equipment to be passed through at least a portion of the umbilical;

a reinforcing element radially surrounding a portion of the umbilical; and a breakout box disposed along the umbilical and configured to be positioned between the reinforcing element and the subsea equipment, wherein the breakout box includes a breakout opening configured to allow one or more breakout cables to exit the umbilical and run along the outside of the reinforcing element to the topside structure.

2. The umbilical system of claim 1, further comprising:

a breakout cable for powering or communicating with subsea equipment, the cable being passed through a portion of the umbilical that is distal to the breakout box and is run along an outside of the reinforcing element to the topside structure.

3. The umbilical system of claim 2, wherein the cable is a medium voltage power cable for powering subsea equipment.

4. The umbilical system of claim 2, wherein the cable is a data cable configured to transfer data between the topside structure and the subsea equipment.

5. The umbilical system of claim 2, wherein the umbilical includes one or more load carrying elements in addition to the one or more cables for powering or communicating with subsea equipment.

6. The umbilical system of claim 2, wherein the one or more breakout cables include every power or data cable within the umbilical and only load carrying elements are passed through the reinforcing element.

7. The umbilical system of claim 1, further comprising:

a conduit running along an outside of the reinforcing elements, the conduit being configured to allow one or more breakout cables to pass through the conduit.

8. The umbilical system of claim 1, further comprising:

three conduits that run along an outside of the reinforcing element, each conduit being configured to allow one or more breakout cables to pass through a respective conduit, wherein the three conduits are positioned approximately 120 degrees apart around the reinforcing element.

9. The umbilical system of claim 1, further comprising:

electrical flying leads that are configured to be connected to the topside structure at a proximal end of the flying lead and electrically connected to the breakout cable at a distal end of the flying lead via an electrical mating connector.

10. The umbilical system of claim 9, wherein the electrical mating connector is integrated into the breakout box, the electrical mating connector being configured to electrically couple a terminal end of the breakout cable located within the breakout box to a terminal end of the flying lead cable located outside the breakout box.

11. The umbilical system of claim 9, wherein the electrical mating connector is positioned outside of the breakout box, the electrical mating connector being configured to electrically couple a terminal end of the breakout cable passed through the breakout box to a terminal end of the flying lead cable located outside the breakout box.

12. The umbilical system of claim 1, wherein the umbilical includes a sheath having an opening formed in a peripheral surface thereof that is sized to allow one or more cables to exit from the umbilical through the opening.

13. The umbilical system of claim 1, wherein the reinforcing element is in the form of a bend stiffener, I or J tube, and/or topside termination.

14. The umbilical system of claim 1, wherein the breakout opening of the breakout box is formed in a peripheral surface of the breakout box.

15. The umbilical system of claim 1, wherein the reinforcing element is configured to be located below the water line when the umbilical system is in use.

16. The umbilical system of claim 1, wherein the reinforcing element is configured to be located above the water line when the umbilical system is in use.

17. A method of assembling a subsea umbilical system, the method comprising:

passing one or more cables for powering or communicating with subsea equipment through a portion of an umbilical;

breaking out one or more cables from the umbilical;

passing the umbilical without the breakout cable(s) through a reinforcing element radially surrounding a portion of the umbilical; and electrically coupling the breakout cable to a topside structure such that the breakout cable is run along an outside of the reinforcing element.

18. The method of claim 17, wherein electrically coupling the breakout cable to a topside structure such that the breakout cable is run along an outside of the reinforcing element includes coupling the breakout cable to an electrical flying lead that runs along the outside of the reinforcing element.

19. The method of claim 18, wherein the breakout cable is connected to a first end of an electrical connector on a first side of a breakout box and the flying lead is connected to a second end of the electrical connector on a second side of the breakout box.

* * * * *

UNITED STATES PATENT AND TRADEMARK OFFICE

CERTIFICATE OF CORRECTION

PATENT NO. : 9,091,146 B1
APPLICATION NO. : 14/257556
DATED : July 28, 2015
INVENTOR(S) : John Whiddon and Heith Little It is certified that error appears in the above-identified patent and that said Letters Patent is hereby corrected as shown below:

In the Drawings

Replace Figures 3 and 10 with enclosed replacement sheets.

In the Specification

At column 1, line 63, replace "more breakout cables to exit the umbilical and run along an" with -- more breakout cables to exit the umbilical and run along and --.

At column 3, line 24, replace "110 and equipment 130. For example, in some embodiments," with -- 110 and subsea well equipment 130. For example, in some embodiments --.

At column 3, line 28, replace "end of system 100 to equipment 130 at a distal end of system" with -- end of system 100 to subsea well equipment 130 at a distal end of system --.

At column 3, line 30, replace "cables for powering or communicating with subsea equip-" with -- cables for powering or communicating with subsea well equip- --.

At column 3, line 64, replace "such (as bend stiffener 160 and tube 190), and subsea equip-" with -- (such as bend stiffener 160 and tube 190), and subsea equip- --.

Signed and Sealed this
Ninth Day of February, 2016

Michelle K. Lee

Michelle K. Lee
*Director of the United States Patent and Trademark Office*